United States Patent [19]

Remark

[11] Patent Number: 4,991,889

[45] Date of Patent: Feb. 12, 1991

[54] SEAL WITH ANNULAR GROOVES

[76] Inventor: Preben M. Remark, Tjornevej 10, DK-2800 Lyngby, Denmark

[21] Appl. No.: 769,756

[22] Filed: Aug. 26, 1985

Related U.S. Application Data

[63] Continuation of Ser. No. 269,014 filed as PCT DK80/00059 or Sept. 26, 1980 published as WO81/00839 on Apr. 2, 1981, abandoned.

[30] Foreign Application Priority Data

Sep. 28, 1979 [DK] Denmark ..... 4077/79

[51] Int. Cl.[5] ..... E05B 39/02

[52] U.S. Cl. ..... 292/327; 292/331

[58] Field of Search ..... 292/318, 319, 323, 324, 292/327, 307 R, DIG. 16; 70/422, 417, 416

[56] References Cited

U.S. PATENT DOCUMENTS

| | | | |
|---|---|---|---|
| 876,028 | 1/1908 | Taylor | 70/422 X |
| 883,501 | 3/1908 | Swallow | 292/307 R |
| 2,796,277 | 5/1957 | Brooks et al. . | |
| 3,330,586 | 7/1967 | Becker et al. . | |
| 3,435,642 | 4/1969 | Del Pesco | 70/49 |
| 3,463,532 | 8/1969 | Chidley et al. | 292/307 R |
| 3,980,337 | 9/1976 | Moberg et al. | 292/319 |
| 3,994,521 | 11/1976 | Van Gompel | 292/319 |
| 4,007,956 | 2/1977 | Harris et al. | 70/422 X |
| 4,161,348 | 7/1979 | Ulrich | 292/307 R X |
| 4,280,726 | 7/1981 | McCoag | 292/327 |
| 4,326,741 | 4/1982 | Wilson | 292/307 R |

FOREIGN PATENT DOCUMENTS

| | | | |
|---|---|---|---|
| 134811 | 1/1977 | Denmark . | |
| 2504423 | 8/1975 | Fed. Rep. of Germany | 292/318 |
| 263455 | 12/1949 | Switzerland . | |

*Primary Examiner*—Lloyd A. Gall

*Attorney, Agent, or Firm*—Scully, Scott, Murphy & Presser

[57] ABSTRACT

Engagement lock comprising two members (1 and 2) which can be interlocked after they are passed through the locking rings (3, 4) of a container. The first member (1) is rod-shaped and has a head (5) which cannot pass through the locking rings (3, 4). Opposite the head it has an insertion end (6) of metal. The lock cannot be broken by bending the rod-shaped body from side to side because this body has a core of steel wire (12) whose elongation extends into the head. The elongation of the steel wire (12) is embedded in polyacetal which also forms the head (5), and the layer of polyacetal around the steel wire (12) has one or more annular grooves (14) in which it can break by bending the rod-shaped body.

8 Claims, 1 Drawing Sheet

SEAL WITH ANNULAR GROOVES

Figure 1:
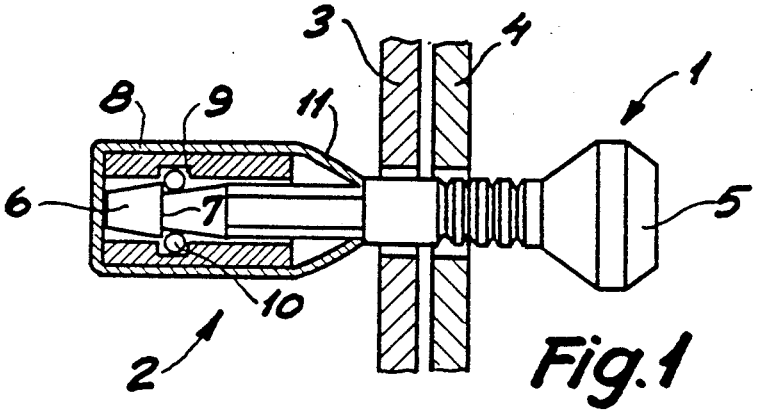

The invention relates to an engagement lock, preferably for a container with locking rings, said lock comprising first and second members adapted for automatic interlocking after the first member has been introduced into a cavity provided in the second member, said first member comprising a rod-shaped body whose one end is adapted for being passed through the looking rings and introduced into the cavity, the other end of said rod-shaped body as well as said second member having such transverse dimensions as prevent them from being passed through the locking rings.

An engagement lock of this type is known from the Danish Patent No. 134 811 corresponding to the British Patent No. 1 498 526. This lock is opened by cutting the rod-shaped body by means of a strong pair of scissors or shears.

However, it has turned out to be possible for an unauthorized person to open this engagement lock by inserting a pipe across one of the two members of the lock and bending it from side to side until the rod-shaped body breaks.

The object of the invention is to provide an engagement lock of said type which cannot be opened in this manner and whose appearance will show clearly whether unauthorized persons have tried to tamper with it.

According to the invention there is provided an engagement lock, preferably for a container with locking rings, said lock comprising first and second members adapted for automatic interlocking after the first member has been introduced into a cavity provided in the second member, said first member comprising a rod-shaped body whose one end is adapted for being passed through the locking rings and introduced into the cavity, the other end of said rod-shaped body as well as said second member having such transverse dimensions as prevent them from being passed through the locking rings, characterized in that said one end of the rod-shaped body has attached therein a core in the form of a steel wire or spring wire or band or other elastic material extending away from said end, and that the other end of the rod-shaped body comprises a core formed by the end of said steel wire extending from said one end of the rod shaped body, and by a layer of rigid material sealingly attached to said core, the outermost part of said layer having said transverse dimension that forms a head.

If an attempt is made at opening the lock of the invention in the manner mentioned above, the material that surrounds and conceals the steel wire breaks and reveals such attempt, but the steel wire yields so as to still retain the head which cannot pass through the locking rings, and the container can therefore not be opened. Moreover, the material around the steel wire braces it, allowing the rod-shaped body, which forms one member of the lock, to be introduced into the other member to be interlocked with it by the stroke of a hammer, without the steel wire being unwound.

One or more annular grooves may be provided in the layer of material around the steel wire and the advantage of this is that when an attempt is made at opening the lock in said manner the layer breaks at the bottom of one of the grooves where the layer is thinnest. Thus, no cracks are formed in the longitudinal direction of the material and accordingly the attachment of the head to the steel wire remains completely intact.

It has been found that the steel wire may very expediently be surrounded by plastics, such as polyacetal. It has also been found that the steel wire may very expediently be surrounded by metal, e.g. steel, zinc or aluminium.

Figure 2:
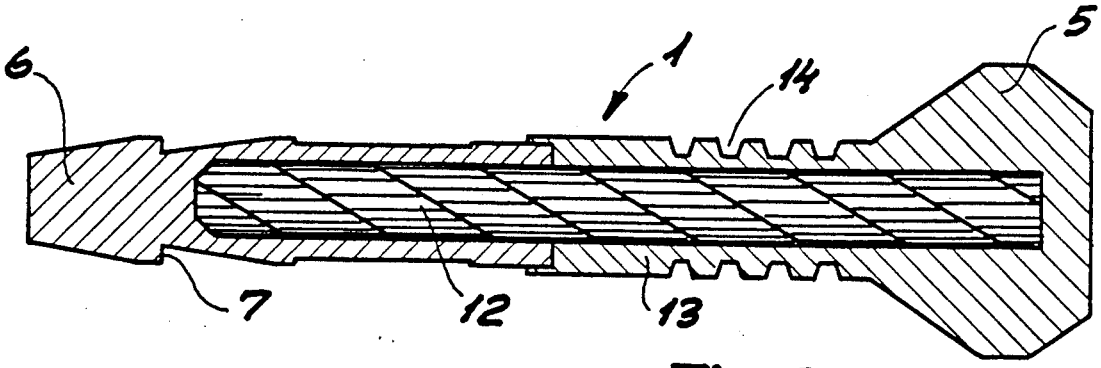

The invention is described in more detail below with reference to the drawing, in which FIG. 1 shows, partly in section, the locked state of a lock of the invention passed through the locking rings of a container, and FIG. 2 shows a longitudinal section of the member of the engagement lock which is formed by the rod-shaped body.

The engagement lock shown in FIG. 1 comprises two members 1 and 2 which are adapted for automatic interlocking after the first member 1, which is in the form of a rod-shaped body, has been introduced into a cavity in the second members 2. The engagement lock is used for locking a container for the transport of goods, the rod-shaped body 1 being passed through the locking rings of the container, indicated by 3 and 4 in FIG. 1, before it is interlocked with the second member 2 of the lock. The rod-shaped member 1, which is preferably circular in cross-section, has at one end a head 5 of considerably larger diameter than the rod-shaped body itself so that the head 5 cannot be passed through the locking rings 3 and 4.

At the opposite end of the head 5 the rod-shaped member 1 has a tapered insertion end 6 and rearwards of said taper an abruptly reduced cross-section area so as to produce a shoulder 7. From the shoulder 7 the cross-section is again increased in the direction of the head 5.

The second member 2 of the lock comprises a circular cylindrical sleeve 8 with an internal, annular recess 9 containing a locking ring 10. The sleeve 8 with the locking ring 10 is encased in a massive envelope 11 of plastics, e.g. polyacetal.

The two members 1 and 2 are interlocked when the insertion end 6 of the rod-shaped body 1 is passed through the locking ring 10 of the sleeve 8 and expands the locking ring 10 against its elastic force until the members 1 and 2 are engaged in the position shown in FIG. 1 in which the locking ring 10 snaps behind the shoulder 7 of the rod-shaped body 1 as a consequence of the elastic force.

The lock is opened by cutting the rod-shaped body 1 by means of a pair of strong scissors or shears which are disposed between the head 5 and the locking ring 4 or between the envelope 11 and the locking ring 3.

The structure of the rod-shaped body 1 appears from FIG. 2. The front, approximately half length of the body 1 with the insertion end 6 consists of a rigid material, preferably metal, in which a core in the form of a steel wire 12 is attached, said steel wire extending away from the insertion end almost in the entire length of the rest of the rod-shaped body 1. The opposite end of the steel wire 12 is embedded in a massive material which also forms the head 5. This material may e.g. be metal or plastics. In the shown embodiment polyacetal is used. A plurality of annular grooves 14 are formed in the polyacetal layer of the cylindrical part 13 forwards of the head 5 so that the thickness of the polyacetal layer on the steel wire is significantly thinner in the bottom of said grooves 14. When an attempt is made at breaking the rod-shaped body the polyacetal layer breaks at the bottom of one of the grooves and the attachment of the head 5 to the steel wire 12 is not affected by this. Therefore, the lock can only be opened by shears in the manner described.

I claim:

1. A seal device applicable, especially to closure means for containers comprising a male part and a female part, said male part comprising an elongated shank having first and second ends, protuberant stop means at said first end for preventing withdrawal of said shank from said closure means by said first end, a male ferrule on said second end having a smaller lateral dimension than said stop means thereby allowing insertion of said shank in said closure means by said second end, said female part having a socket for reception of said male ferrule, and said device including locking means for cooperating with said male ferrule and said socket to couple said male and female parts within said socket when said male ferrule is inserted in said socket, whereby said female part prevents withdrawal of said shank from said closure means, characterized in that said shank comprises a wire means and a rigid layer to stiffen and brace the wire means, said rigid layer including a plurality of annular grooves to create lines of weakness, said rigid layer permitting the male and female parts to be interlocked with a stroke of a hammer without unraveling said wire means.

2. A seal device as claimed in claim 1 wherein said rigid layer totally surrounds the wire means and is sufficiently brittle to break when an attempt is made to open the seal by bending.

3. A seal device as claimed in claim 1 or 2 wherein said rigid layer around the wire means consists of a plastic material such as polyacetal.

4. A seal device as claimed in claim 1 or 2 wherein said rigid layer around the wire means is formed of metal.

5. A sealing device for a container with locking rings, said device comprising a first and a second member adapted for snap fit interlocking after the first member has been introduced into a cavity provided in the second member; said first member further comprising a rod shaped elongate body with an insertion end suitable for introduction into said cavity, and a head end, said head end as well as said second member having a larger transverse dimension than the insertion end so as to render them suitable for use with locking rings of internal dimension intermediate that of the insertion end and the head end and second member, said insertion end of said elongate body being formed by a flexible core in the form of a wire means, said core being embedded in a layer of rigid material, the other end of said core extending into the head end of said elongate body and embedded in a layer of rigid material for form a head member, said lock characterized in that the flexible core is totally surrounded by a layer of material which braces the core and which is sufficiently rigid to allow the elongate body which forms one member of the lock to interlock with the second member by the stroke of a hammer, without the flexible core being unwound, said layer of material surrounding the core including one or more annular grooves to create lines of weakness.

6. A sealing device as claimed in claim 5 further characterized in that the layer which totally surrounds the flexible core is sufficiently brittle to break when an attempt is made to open the lock by bending said core.

7. A sealing device according to claims 5 or 6 which is further characterized in that the rigid layer around the flexible core consists of a plastic material such as polyacetal.

8. A sealing device according to claims 5 or 6 which is further characterized in that the rigid layer around the flexible core consists of a metal.

* * * * *